US009376281B2

(12) United States Patent
D'Souza

(10) Patent No.: US 9,376,281 B2
(45) **Date of Patent: *Jun. 28, 2016**

(54) CAM-CONTROLLED CORE INSERTER FOR A SURFACE WINDER

(71) Applicant: The Procter & Gamble Company, Cincinnati, OH (US)

(72) Inventor: Stephen Scott D'Souza, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 331 days.

This patent is subject to a terminal disclaimer.

(21) Appl. No.: 14/071,689

(22) Filed: Nov. 5, 2013

(65) Prior Publication Data

US 2015/0069167 A1 Mar. 12, 2015

Related U.S. Application Data

(60) Provisional application No. 61/875,172, filed on Sep. 9, 2013.

(51) Int. Cl.
*B65H 75/24* (2006.01)
*B65H 19/22* (2006.01)

(52) U.S. Cl.
CPC ..... *B65H 19/223* (2013.01); *B65H 19/2269* (2013.01); *B65H 2402/512* (2013.01); *B65H 2402/64* (2013.01); *B65H 2403/51* (2013.01); *B65H 2403/512* (2013.01); *B65H 2701/1924* (2013.01)

(58) Field of Classification Search
CPC ..... B65H 19/223; B65H 19/2269; B65H 2701/1924; B65H 2402/64; B65H 2403/51; B65H 2402/512; B65H 2403/512
See application file for complete search history.

(56) References Cited

U.S. PATENT DOCUMENTS 4,828,195 A 5/1989 Hertel et al.
5,137,225 A 8/1992 Biagiotti
5,249,756 A 10/1993 Biagiotti
(Continued)

FOREIGN PATENT DOCUMENTS

EP 0968946 B1 3/2003

OTHER PUBLICATIONS

U.S. Appl. No. 14/072,100 to D'Souza.*
(Continued)

*Primary Examiner* — Howard Sanders
(74) *Attorney, Agent, or Firm* — Peter D. Meyer

(57) ABSTRACT

A cam-controlled core inserter for a surface winder is disclosed. The device has a cam housing having a longitudinal axis, a cam disposed within a first surface of the cam housing, a fixed finger plate juxtaposed proximate to the cam housing and the cam, and a first cam follower cooperatively associated with the cam. The fixed finger plate has a fixed finger fixably attached thereto. The first cam follower has a finger shaft disposed through the fixed finger plate and has a movable finger attached thereto. The movable finger has an adjustable orientation relative to the longitudinal axis as the first cam follower orbits about the longitudinal axis. The distal end of the movable finger and the distal end of the fixed finger are capable of forming a space therebetween for contacting engagement and containment of a core suitable for the convolute disposal of a web material thereabout.

20 Claims, 12 Drawing Sheets

(56) References Cited

U.S. PATENT DOCUMENTS

| | | | | |
|---|---|---|---|---|
| 5,370,335 | A | 12/1994 | Vigneau | |
| 5,772,149 | A | 6/1998 | Butterworth | |
| 6,000,657 | A * | 12/1999 | Butterworth | B65H 19/2269 242/521 |
| 6,056,229 | A | 5/2000 | Blume et al. | |
| 6,422,501 | B1 | 7/2002 | Hertel et al. | |
| 7,175,127 | B2 | 2/2007 | Butterworth et al. | |
| 7,318,562 | B2 | 1/2008 | Biagiotti et al. | |
| 7,398,942 | B2 | 7/2008 | Benvenuti et al. | |
| 7,802,748 | B2 | 9/2010 | De Matteis et al. | |
| 7,891,598 | B2 | 2/2011 | Maddaleni et al. | |
| 7,942,363 | B2 | 5/2011 | Gelli et al. | |
| 8,267,344 | B2 | 9/2012 | Maddaleni et al. | |
| 2013/0020427 | A1 | 1/2013 | Gelli et al. | |

OTHER PUBLICATIONS

PCT International Search Report, mailed Jan. 30, 2015, 136 pages.
U.S. Appl. No. 14/072,100, filed Nov. 5, 2012, Stephen Scott D'Souza.

* cited by examiner

CAM-CONTROLLED CORE INSERTER FOR A SURFACE WINDER

FIELD OF THE INVENTION

This present disclosure relates to a surface winder for winding a web into rolls or logs. More particularly, the present disclosure relates to an in-feed mechanism for feeding cores axially into a surface winder and for moving the cores toward the winding rolls of the winder.

BACKGROUND

In the paper converting industry, rewinding machines are used for the production of tissue paper articles in the form of wound rolls, such as bath tissue, paper toweling, and the like. These rewinding machines generally have the function of rewinding a web material coming from large reels (so-called parent reels) into logs having a diameter equal to the diameter of the wound finished articles which are then sold to consumers. These logs are much longer than the axial length of the finished articles that are sold. Therefore, the logs are generally cut square to their axis to obtain the finished product which is subsequently packaged.

Winding or rewinding a web material is usually performed in a continuous manner at high speed. For example, winding one single log can occur in about 1-3 seconds. At the end of winding a log, the web material is severed (i.e. torn or cut) to create a trailing edge of web material for the finished log and a leading edge of web material for a succeeding (e.g., next) log. Severing the web material, discharging the finished log, and the beginning of winding of the next log are generally known to those of skill in the art as an exchange phase or operation. This operation is performed typically without interrupting or slowing down the feed of the web material in order to maintain a set hourly throughput.

Winding a web material usually occurs around tubular winding cores. The leading edge of the web material is typically adhered to the core material with an adhesive. Some operations may utilize suction provided from inside an apertured core material. In still other embodiments, a tubular core can be electrostatically charged to attract the free leading edge of the web material.

Surface rewinding machines provide for the winding of a log that is in contact with the surface of at least two winding rollers. More precisely, the log is formed starting from a continuous web material that is provided with transverse perforations. The perforated web material is carried by a first conveyor and is wrapped at least partially around an upper winding roller. A core having adhesive disposed thereon is placed into contacting engagement with the web material disposed about the upper winding roller. The material-adhered core then enters into contact with a lower winding roller and is kept in rotating engagement between both the upper and lower winding rollers with a pressure roller. The three rollers form a 'cradle' and define a 'winding zone' wherein the wound log is formed by rotating the core and disposing the web material onto the core as it rotates within the winding zone.

The core can be inserted into the winding zone in a plurality of manners. In a first case, one a core at a time can be fed onto a loading tray and a pusher disposes the core into the winding zone. Here, the pusher forces the core into position between the winding rollers. This can result in the core being dented in the winding zone and producing a faulty winding.

In a second method, the core can be brought on a feeding cradle of curved shape located under the upper winding roller.

Friction against the upper roller brings it forward up to the contact with the lower winding roller for starting the winding. The cradle is formed by a series of integral curved guides that protrude rearwardly from the lower winding roller. According to the size of the core, the lower roller is brought forward or away from the upper roller. However, a different cradle is necessary for each different diameter of the core. This causes stops in the production, an adjusting work and the need of a set of cradles, one for each different diameter of the core.

A third method provides an inserter that allows for independent movement of pneumatically activated fingers disposed across the width of the rewinder that grip an incoming core and translate it to the winding zone. An exemplary inserter that functions in this manner is shown in FIGS. 1 and 2. As can be seen, this method positively controls the motion of the finger in only one direction and has significant variability in speed due to contaminants in the process and the fragility of the design. This can lead to failure to insert the core at the right time in the wind cycle, release of the core prematurely, or even impeding the core from insertion by the insertion finger causing jams, web breaks, and roll wraps.

Thus, it would be easily recognized by one of skill in the art that a better system for inserting cores into the winding cradle of a surface rewinding system is needed. Such an improved winding system would provide better control of the core during the insertion process, provide a more reliable and consistent insertion in production, and provide an insertion system that is not as effected by contamination generated during the rewinding process.

SUMMARY OF THE INVENTION

The present disclosure provides for a cam-controlled core inserter for a surface winder. The cam-controlled core insertion device provides for a cam housing having a longitudinal axis disposed therethrough, a cam disposed within a first surface of the cam housing, a fixed finger plate juxtaposed proximate to the cam housing and the cam, and a first cam follower cooperatively associated with the cam. The cam is disposed within the cam housing about the longitudinal axis. The fixed finger plate is fixably attached to a shaft disposed through the cam housing and has a fixed finger fixably attached thereto. The shaft is disposed coaxially about the longitudinal axis and is rotatable thereabout. The fixed finger has a fixed orientation relative to the longitudinal axis as the shaft rotates about the longitudinal axis. The fixed finger has an end distal from the fixable attachment to the fixed finger plate. The first cam follower has a finger shaft attached thereto. The finger shaft is disposed through the fixed finger plate and has a movable finger attached thereto. The first cam follower orbits about the longitudinal axis while juxtaposed proximate to and in contacting engagement with the cam. The movable finger has an adjustable orientation relative to the longitudinal axis as the first cam follower orbits about the longitudinal axis and has an end distal from the first cam follower. The distal end of the movable finger and the distal end of the fixed finger are capable of forming a space therebetween for contacting engagement and containment of a core suitable for the convolute disposal of a web material thereabout. The cam causes the movable finger to rotate toward the fixed finger when the first cam follower is disposed at a first orbital position relative to the longitudinal axis to engage the core between the distal end of the movable finger and the distal end of the fixed finger. The cam causes the movable finger to rotate away from the fixed finger to disengage from the core when the first cam follower is disposed at a second orbital position relative to the longitudinal axis.

DETAILED DESCRIPTION OF THE INVENTION

Figure 1:
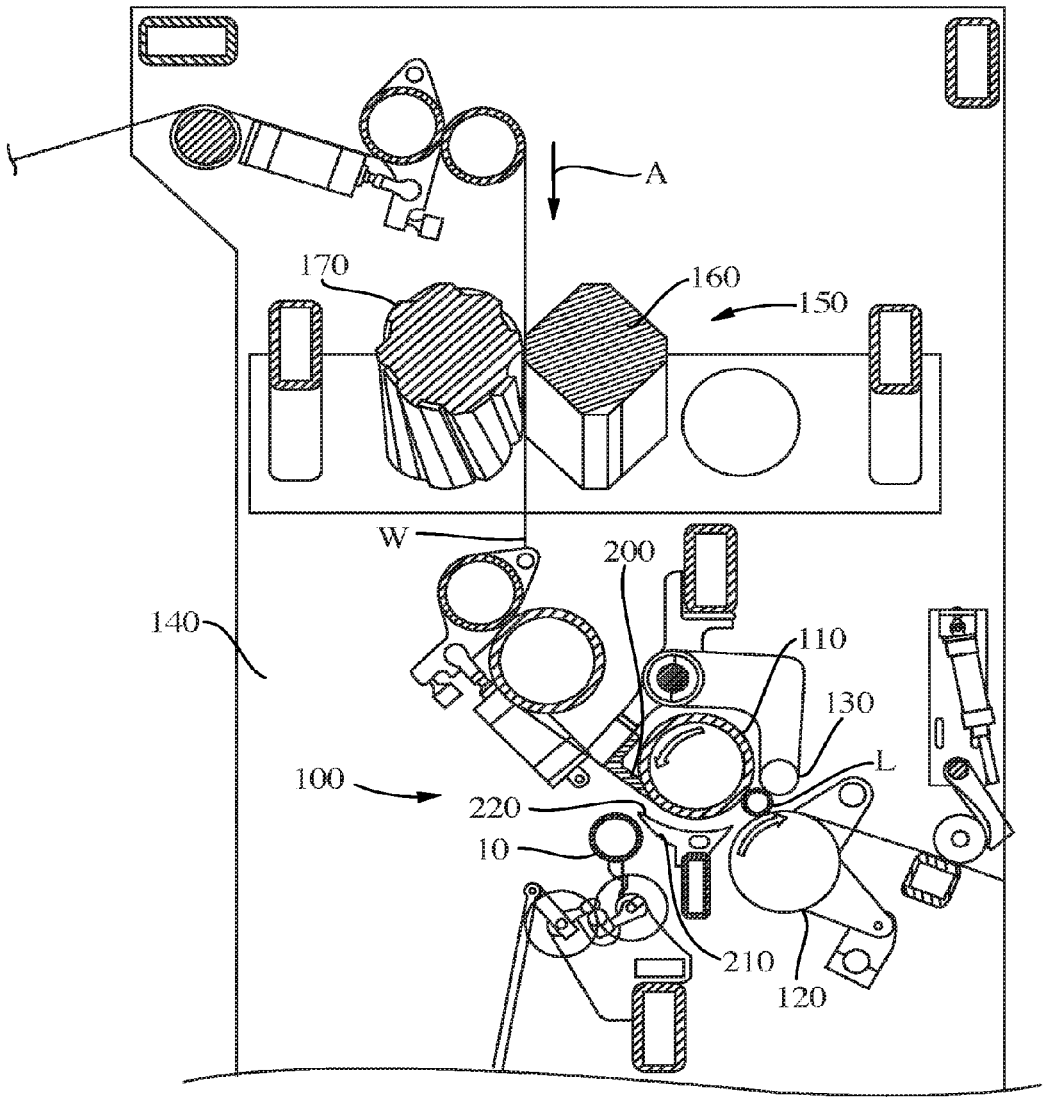
Fig. 1 (PRIOR ART)
FIG. 1 is a fragmentary side elevational view of an exemplary prior art surface winder including a core in-feed apparatus

FIG. 1 illustrates an exemplary surface winder (or re-winder) 100 that utilizes prior art core inserter 10. Without limitation, such a surface winder 100 is generally described in U.S. Pat. No. 6,056,229. The exemplary re-winder 100 can generally include a conventional three roll winding cradle that provides a first or upper winding roll 110, a second or lower winding roll 120, and a rider roll 130. The rolls are mounted in a frame 140 for rotation in the direction of the arrows to wind a web material W having a path through the frame 140 on a hollow cardboard core 12 that is used to form a log L of convolutely wound paper such as bathroom tissue or paper toweling.

The second winding roll 120 can be movably mounted on the re-winder so that the roll can move toward and away from the first winding roll. This is generally described in U.S. Pat. Nos. 4,828,195 and 4,909,452. The second winding roll can be provided with a variable speed profile. A non-limiting and exemplary variable speed profile is described in U.S. Pat. No. 5,370,335.

The rider roll 130 is pivotably mounted so that it can move toward lower winding roll 120 when the core is inserted into the three roll winding cradle. The rider roll 130 can move away from the lower winding roll 120 as web material W is convolutely wound about core 12 as the winding log builds.

The web material W is preferably advanced in a downstream direction as indicated by the arrow A. The web material W can be (and can be preferably) transversely perforated along longitudinally spaced lines of perforation to form individual sheets. In the particular embodiment illustrated, a perforator assembly 150 includes an anvil 160 and a rotating perforating roll 170.

Before the web material W reaches the first winding roll 110, it can traverse over a stationary pinch bar 200 mounted adjacent to the first winding roll 110. A stationary plate 210 (also referred to by those of skill in the art as a transfer plate or dead plate) can be mounted below the first winding roll 110 upstream of the second winding roll 120. The upstream end 220 of the stationary plate 210 is spaced from the first winding roll 110 a distance slightly greater than the diameter of the cores 12. The spacing between the remainder of the stationary plate 210 and the first winding roll 110 is slightly less than the diameter of the cores 12 so that the cores 12 will be compressed slightly and will be rolled along the stationary plate 210 by the rotating first winding roll 110. The stationary plate 210 includes a solid portion which generally extends for the axial length of the re-winder 100.

Cores 12 can be typically fed to the core inserter 10 from a conventional core magazine (not shown). A glue applicator (not shown) can apply an axially extending stripe of glue on the core 12 as the core 12 moves past the glue applicator (not shown). An exemplary glue applicator (not shown) can include a spray nozzle that can spray a heated glue or cold adhesive onto the core 12. Other types of glue applicators can also be used for applying a continuous or intermittent line of glue to the core 12. This could include slot extruders, printers, and glue wheels.

Figure 2:
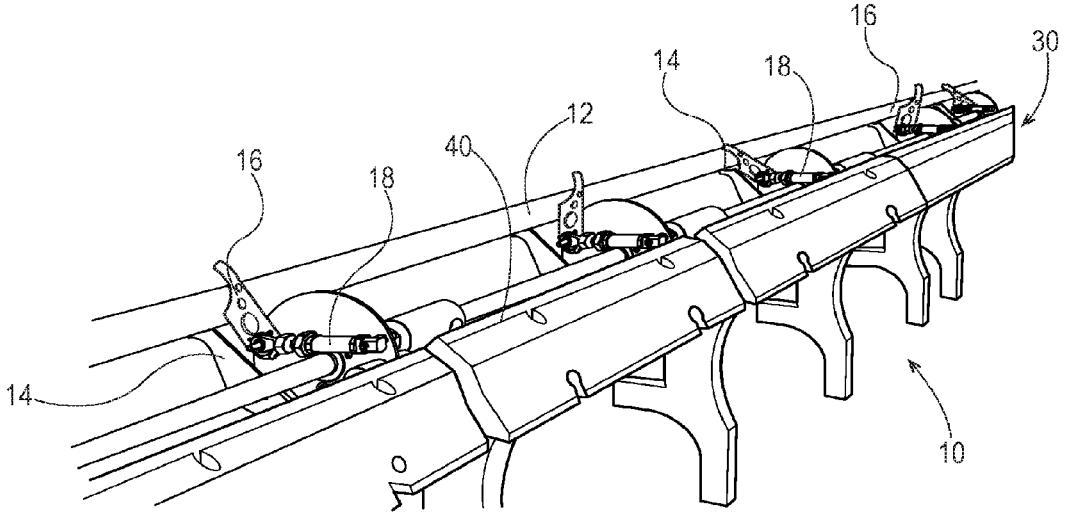
Fig. 2 (PRIOR ART)
FIG. 2 is perspective view of an exemplary core insertion device of the prior art showing the misalignment of the pneumatically-controlled fingers.
Figure 3:
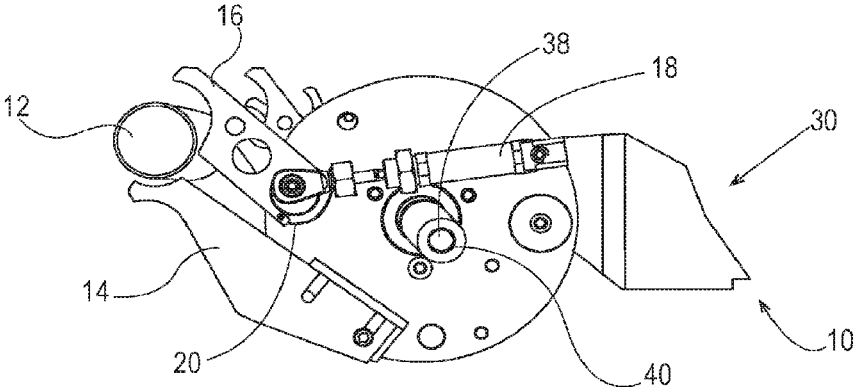
Fig. 3 (PRIOR ART)
FIG. 3 is a representative elevational view of the exemplary prior art core insertion device of FIG. 1 showing the misalignment of the pneumatically-controlled fingers.

Referring to FIGS. 2-3, a typical prior art core inserter 10 is mounted on a shaft 40 that is rotatably mounted on the frame 140 for rotation about longitudinal axis 38. The core inserter 10 includes a plurality of axially spaced arms (fixed finger 14 and pivot finger 16) that extend radially outwardly from the shaft 38. Generally, a pneumatically actuated cylinder 18 can extend to allow pivot finger 16 to rotate toward core 12 and fixed finger 14 thereby containing core 12 between fixed finger 14 and pivot finger 16. Pneumatically actuated cylinder 18 can also retract thereby causing pivot finger 16 to rotate away from core 12 and fixed finger 14 thereby releasing core 12 from a fixed disposition between fixed finger 14 and pivot finger 16

Referring to FIGS. 1-3, the core inserter 10 generally rotates clockwise to move a core 12 into the space between the upstream end 220 of the stationary plate 210 and the first winding roll 110. The core inserter 10 can be rotated by a servo motor that can be controlled by a microprocessor. At the appropriate time during the winding cycle, the servo motor can be actuated to rotate the core inserter 10 clockwise.

As the core inserter 10 continues to rotate, fixed finger 14 and pivot finger 16 on the core inserter 10 push the core 12 into contacting engagement with the first winding roll 110 and the stationary plate 210, and the rotating winding roll 110 causes the core 12 to roll over the stationary plate 210. If an axial glue stripe is disposed upon the core 12, the glue stripe can contact the severed web material W, and the web material W can then begin to be convolutely wound about the core 12 as the core 12 rolls over the stationary plate 210. Fixed finger 14 and pivot finger 16 both pass through gaps disposed within stationary plate 210 as the core inserter 10 rotates clockwise. When the core 12 and the winding log L reach the second winding roll 120, the winding log L continues to have web material W wound thereabout as the winding log L is disposed between the first winding roll 110 and second winding roll 120. Winding log L is eventually contacted by the rider roll 130 that applies a compressive force to the winding log L.

As can be seen in FIGS. 2 and 3, a typical commercially available core inserter 10 provides independent movement of each pivot finger 16 disposed across the length of the core inserter 10 (i.e., collectively disposed in the cross-machine direction (CD) of web material W) through a respective pneumatically activated cylinder 18 (sometimes accompanied by a spring return). As would be recognized by one of skill in the art, because of the nature of pneumatically activated cylinders 18 and the systems used for the control of pneumatically activated cylinders 18, a core inserter 10 may only positively control the motion of each pivot finger 16 orbitally about the longitudinal axis 38. Such control provides significant variability to the speed and rotational displacement of each pivot finger 16 about longitudinal axis 38 due to contaminants in the process and the fragility of the design.

For example, an uneven flow of air in an air feed system used to activate each pneumatically activated cylinder 18 of core inserter 10 or any binding in the core inserter 10 system can cause the core inserter 10 to secure the core 12 late. In addition, if a spring return is used (e.g., a 'spring unload') age and wear of the spring can dramatically change the speed and strength of the core 12 loading and core 12 unloading (i.e., core 12 disengaging from between fixed finger 14 and pivot finger 16) process. The use of a spring return can also cause a 'bounce' of the pivot finger 16 which may interfere or impede the release of the core 12 into the winding cradle 30. Experience has indicated that this can lead to failure to insert the core 12 at the right time in the wind cycle, release of the core 12 from containment between fixed finger 14 and pivot finger 16 prematurely, or impede the core 12 from insertion into the winding cradle 30 space between stationary plate 210 and first winding roll 110. Overall, this can result in the pivot finger 14 causing jams, web material W breaks, winding log L wraps, as well as wraps about first winding roll 110 and/or second winding roll 120. This can also lead to a delay in securing or releasing the core 12 for insertion into the space between the upstream end 220 of the stationary plate 210 and the first winding roll 110 resulting in the need for additional dwell time thereby adversely impacting process speeds.

In light of these issues generally experienced by users of the prior art core inserter 10 in conjunction with a surface winder 100, using the cam-controlled core inserter 10A of the present disclosure in place of the prior art core inserter 10 can effectively reduce these detrimental experiences.

Figure 4:
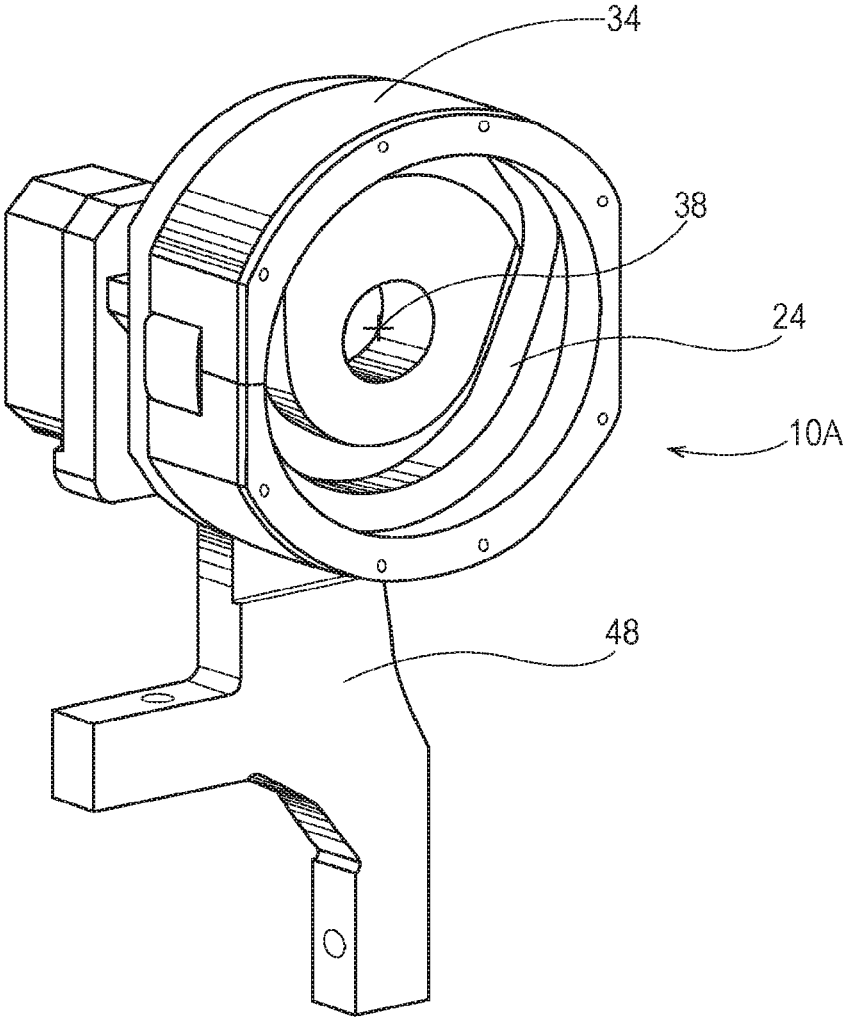
FIG. 4 is a perspective view of an exemplary cam housing for a cam-controlled core insertion device of the present disclosure showing an exemplary cam.
Figure 5:
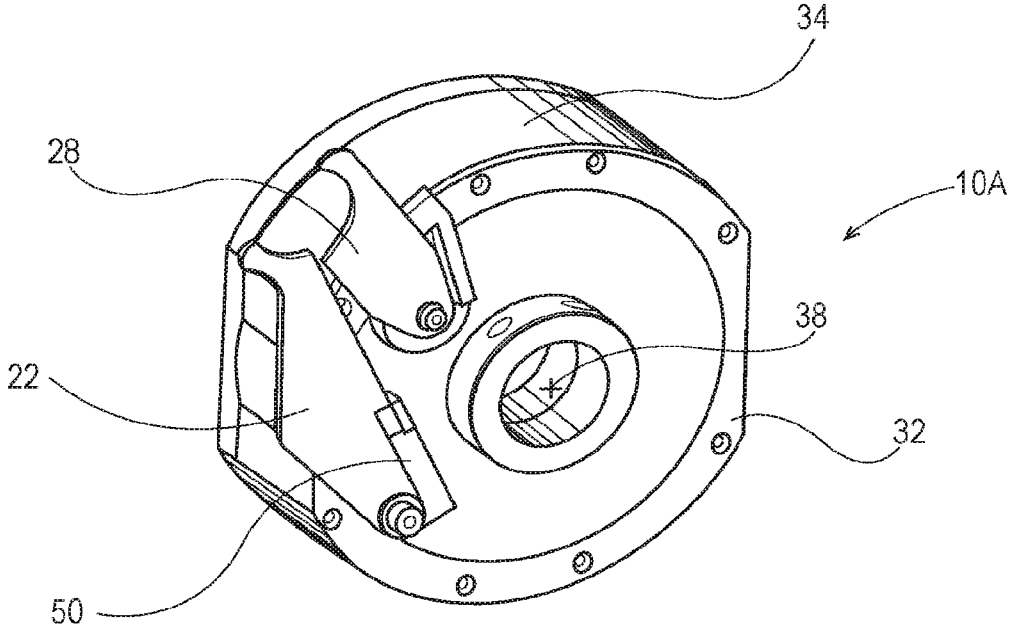
FIG. 5 is another perspective view of the exemplary cam housing of the cam-controlled core insertion device of FIG. 4 showing fixed and movable fingers attached thereto.
Figure 6:
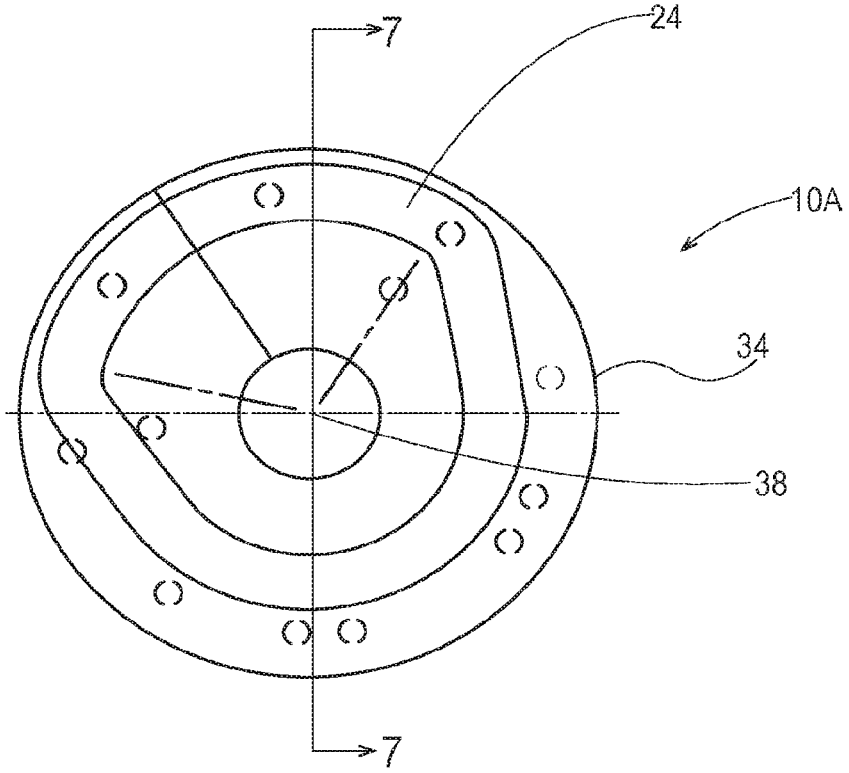
FIG. 6 is an exemplary elevational view of the cam housing of the cam-controlled core insertion device of FIG. 4 showing an exemplary cam.
Figure 7:
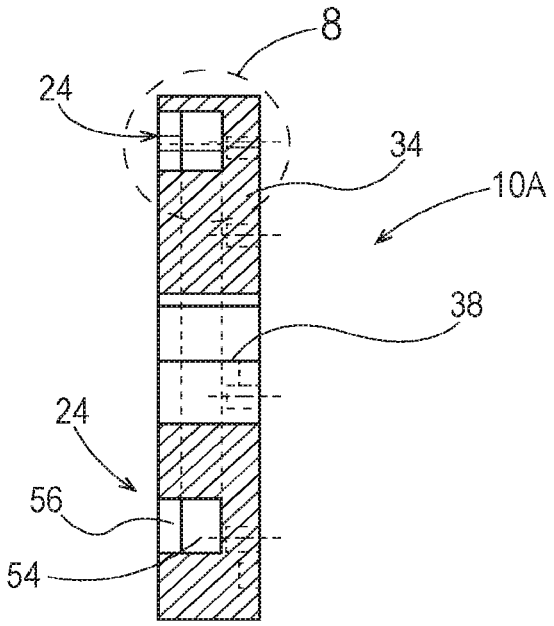
FIG. 7 is a cross-sectional view of the exemplary cam-controlled core insertion device of FIG. 6 taken along line 7-7.
Figure 8:
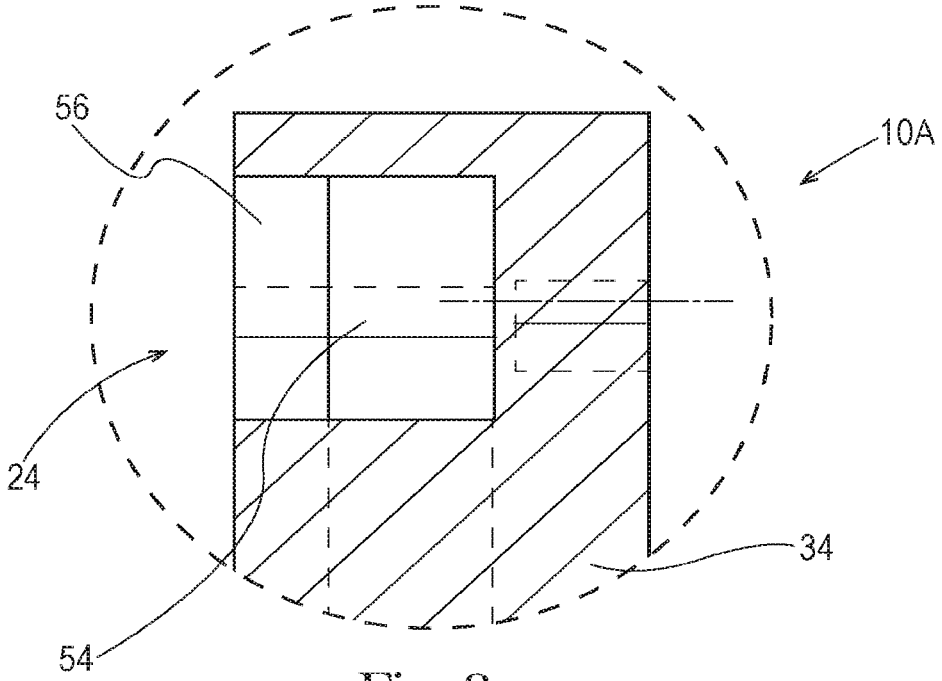
FIG. 8 is an expanded view of the region labeled 8 in the cross-sectional view of FIG. 7 showing additional cam detail.

The improved cam-controlled core inserter 10A a shown generally in the perspective views of FIGS. 4-5. The improved cam-controlled core inserter 10A is generally provided with a cam housing 34 that is fixably mountable to frame 140 by bracket 48. Shaft 40 is disposable therethrough.

The cam-controlled core inserter 10A is provided with fixed finger 22 and movable finger 28. A suitable core 12 for convolutely winding a web material W thereabout can be disposed between fixed finger 22 and moveable finger 28 for insertion into winding cradle 30 of any form of surface winder 100.

As shown in FIGS. 6-10, cam housing 34 of cam-controlled core inserter 10A is generally provided with a cam 24. Cam 24 can be disposed within or disposed about cam housing 34 and defines the orbital motion of cam follower 26 disposed therein and having movable finger 28 attached thereto about the longitudinal axis 38 of cam-controlled core inserter 10A. Cam 24 can be provided with any desired profile required by the manufacturing operation to provide the desired motion of cam follower 26 about the longitudinal axis 38.

Figure 9:
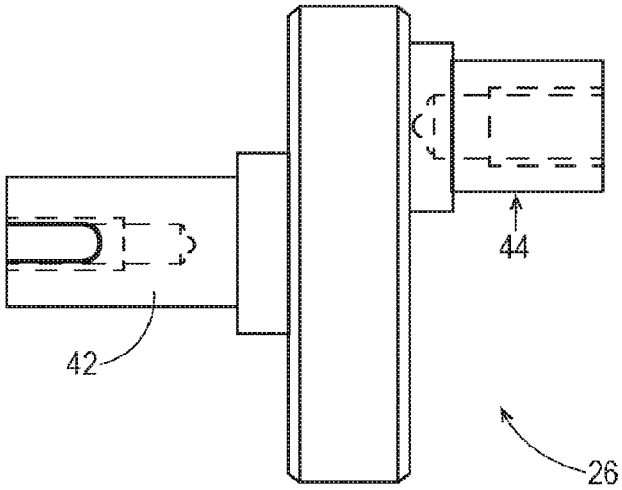
FIG. 9 is an elevational view of an exemplary cam follower suitable for use with the cam-controlled core insertion device of FIG. 4.

In this regard, movable finger 28 can be disposed upon finger shaft 42 emanating from a centroid of cam follower 26 (shown in FIG. 9). Cam contacting shaft 44 is provided to be contained within cam 24 in a manner that causes cam 24 to orbit about the longitudinal axis 38 of cam-controlled core inserter 10A. As cam 24 orbits about the longitudinal axis 38 while disposed in contacting and moveable engagement with cam 24, cam 24 defines the motion of movable finger 28 relative to the longitudinal axis 38, fixed finger 22, and core 12. Without desiring to be bound by theory, it is believed that by providing a cam 24/cam follower 26 system to control the movement of movable finger 28 of cam-controlled core inserter 10A can provide a more reliable and consistent contact and release system for the insertion of a core 12 into winding cradle 30. In other words a cam 24/cam follower 26 system can more positively actuate and control movement of movable finger 28 about longitudinal axis 38 relative to both the closed (i.e., fixed finger 22 and movable finger 28 are positively engaged with core 12) and open (i.e., fixed finger 22 and movable finger 28 are disengaged from core 12) position.

Figure 10:
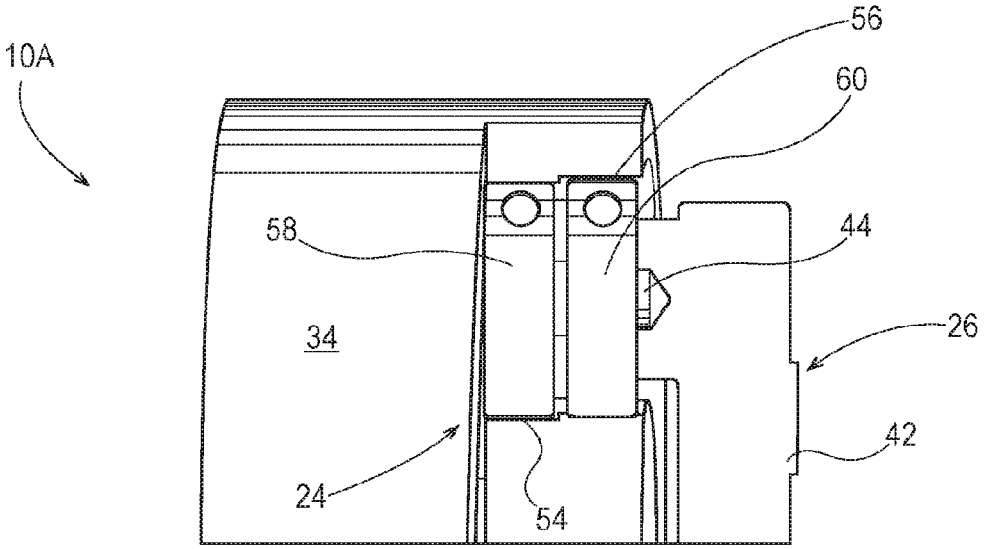
FIG. 10 is an elevational view of an exemplary dual-track cam/cam follower system suitable for use with a movable finger of the cam-controlled core insertion device of FIG. 4

As shown in FIG. 10, it is believed that cam 24 disposed within cam housing 34 can be provided with a first cam track portion 54 and second cam track portion 56. Providing such an 'off-set dual cam' embodiment for cam 24 can better define the orbital motion of cam follower 26 disposed therein as well as the motion of movable finger 28 attached thereto about pivot 52 as well as the longitudinal axis 38 of cam-controlled core inserter 10A. As can also be seen, cam contacting shaft 44 of cam follower 26 can be provided with a first cam follower bearing 58 and second cam follower bearing 60. In this exemplary embodiment, first cam follower bearing 58 is preferably maintained in contacting and roller-like engagement with first cam track portion 54 and second cam follower bearing 60 is preferably maintained in contacting and roller-like engagement with second cam track portion 56. One of skill in the art will clearly recognize that this off-set dual cam arrangement of cam 24/cam follower 26 can prevent counter-rotation of cam follower 26. One of skill in the art will also clearly recognize that this off-set dual cam arrangement of cam 24/cam follower 26 can prevent any sliding of cam follower 26 within cam 24 when cam follower 26 transitions from first cam track portion 54 to second cam track portion 56 as movable finger 28 is being rotated about pivot 52 either toward fixed finger 22 or away from fixed finger 22. One of skill in the art will easily understand that such an off-set dual cam system can provide the benefit of requiring only a single servo drive in order to accomplish two separate motion profiles.

Figure 11:
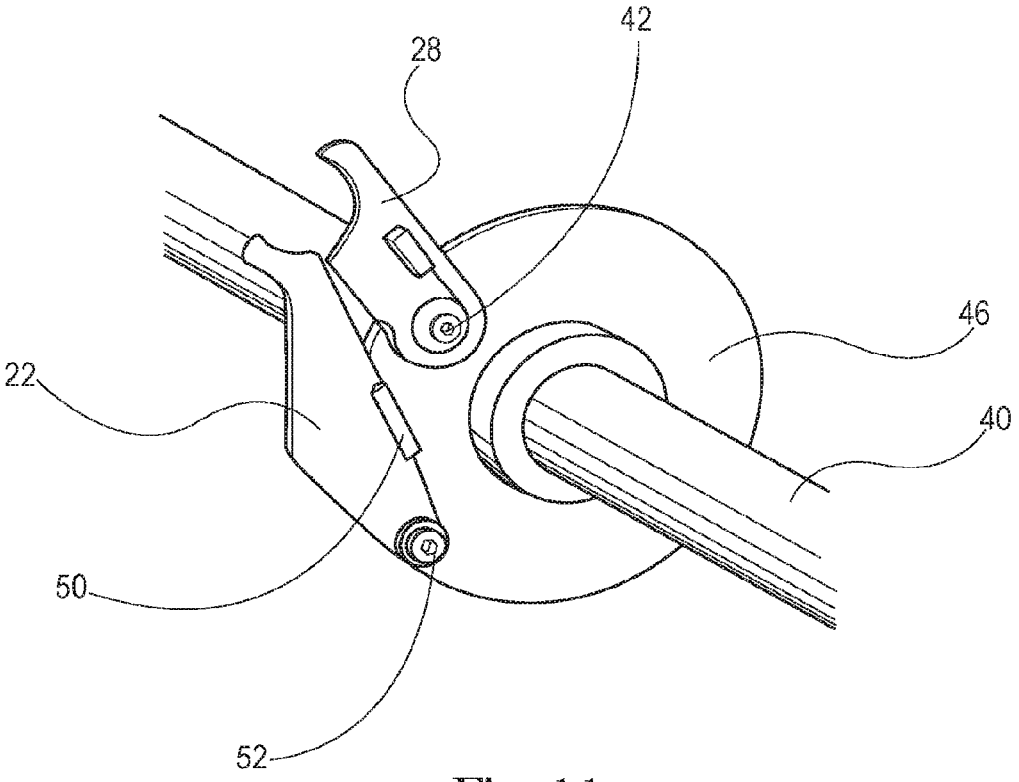
FIG. 11 is a plan view of an exemplary fixed finger plate suitable for use with the cam-controlled core insertion device of FIG. 4 showing a fixed finger and movable finger attached thereto.
Figure 12:
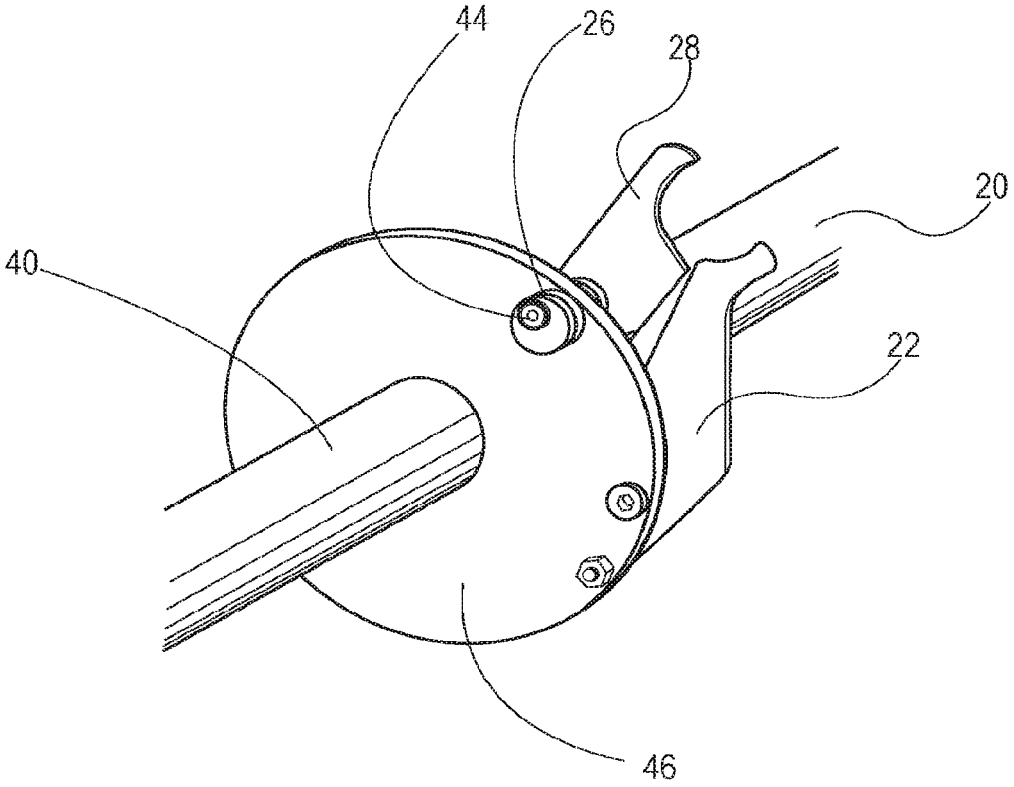
FIG. 12 is a plan view of the reverse side of the fixed finger plate of FIG. 10.

Referring now to FIGS. 11-12, shown in perspective view is a fixed finger plate 46 that is fixably attached to shaft 40. Fixed finger 22 is secured to fixed finger plate 46 so that fixed finger 22 will maintain a fixed orientation relative to shaft 40 and longitudinal axis 38 as shaft 40 and fixed finger plate 46 are rotated about longitudinal axis 38. Thus, each fixed finger 22 associated with cam-controlled core inserter 10A will have the same orientation when initiating contact with a core 12. Cam contacting shaft 44 of cam follower 26 is disposed through fixed finger plate 46 so that cam contacting shaft engages cam 24. Thus, as shaft 40 rotates about longitudinal axis 38, fixed finger plate 46 connected to shaft 40 rotates thereabout. This causes fixed finger 22 to orbit about longitudinal axis 38 in fixed orientation and causes cam follower 26, engaged with cam 24 disposed within cam housing 34, to also orbit about longitudinal axis 38 with the cam 24 and cam follower 26 interaction causing the orientation of moveable finger 28 relative to longitudinal axis 38 to change as may be required in order to engage, contain, transport, and disengage core 12 as may be required to insert core 12 into winding cradle 30.

Further, it is believed that each fixed finger plate 46 can be provided with an associated latch 50 (e.g., a first latch, a second latch, a third latch, etc.) that is fixably disposed upon fixed finger plate in an orientation that allows cooperative engagement with fixed finger 22. Each latch 50 can assist in securing the associated fixed finger 22 in a fixed orientation relative to shaft 40 and longitudinal axis 38 as shaft 40 and fixed finger plate 46 are rotated about longitudinal axis 38. Each latch 50 can also facilitate the pivotable movement of an associated fixed finger 22 (as well as the distal end of fixed finger 22) about pivot point 52 in a direction generally away from moveable finger 28. Such a scenario can be understood by one of skill in the art as useful when cam-controlled core inserter 10A and/or any component thereof experiences a mechanical and/or operational malfunction. Such malfunctions can include, but not be limited to, the mechanical binding (e.g., a 'jam') of cam-controlled core inserter 10A and/or any component thereof, a misfeed of core 12 into cam-controlled core inserter 10A and/or surface winder 100, and the like.

It is envisioned that latch 50 can be provided as a magnetic latch. It is also believed that one of skill in the art could provide latch 50 as a safety mechanism incorporating the use of a shear pin. Other embodiments of latch 50 could provide a slip-clutch, ball detent, or other such mechanism that can provide the reversible nature and safety-oriented goals intended by the presence of latch 50. Such a cam 24/cam follower 26 system provided for cam-controlled core inserter 10A as described herein can provide for the relationships of each fixed finger 22/moveable finger 28 pair of cam-controlled core inserter 10A to be identical relative to longitudinal axis 38 across the entire cross-machine direction of cam-controlled core inserter 10A. In other words, the movement of each fixed finger 22/movable finger 28 pair can be more accurately coordinated, alone and collectively. This can provide for a significantly more precise engagement of core 12 between fixed finger 22 and movable finger 28 and control of core 12 as it traverses from a point of initial contacting engagement (i.e., pick-up) between fixed finger 22 and movable finger 28 to a point of release of the core 12 from between fixed finger 22 and movable finger 28 for insertion into winding cradle 30. Further, as will be shown infra, release of the core 12 from between fixed finger 22 and movable finger 28 into winding cradle 30 can be achieved much later in the transfer process with significantly more control.

Figure 13:
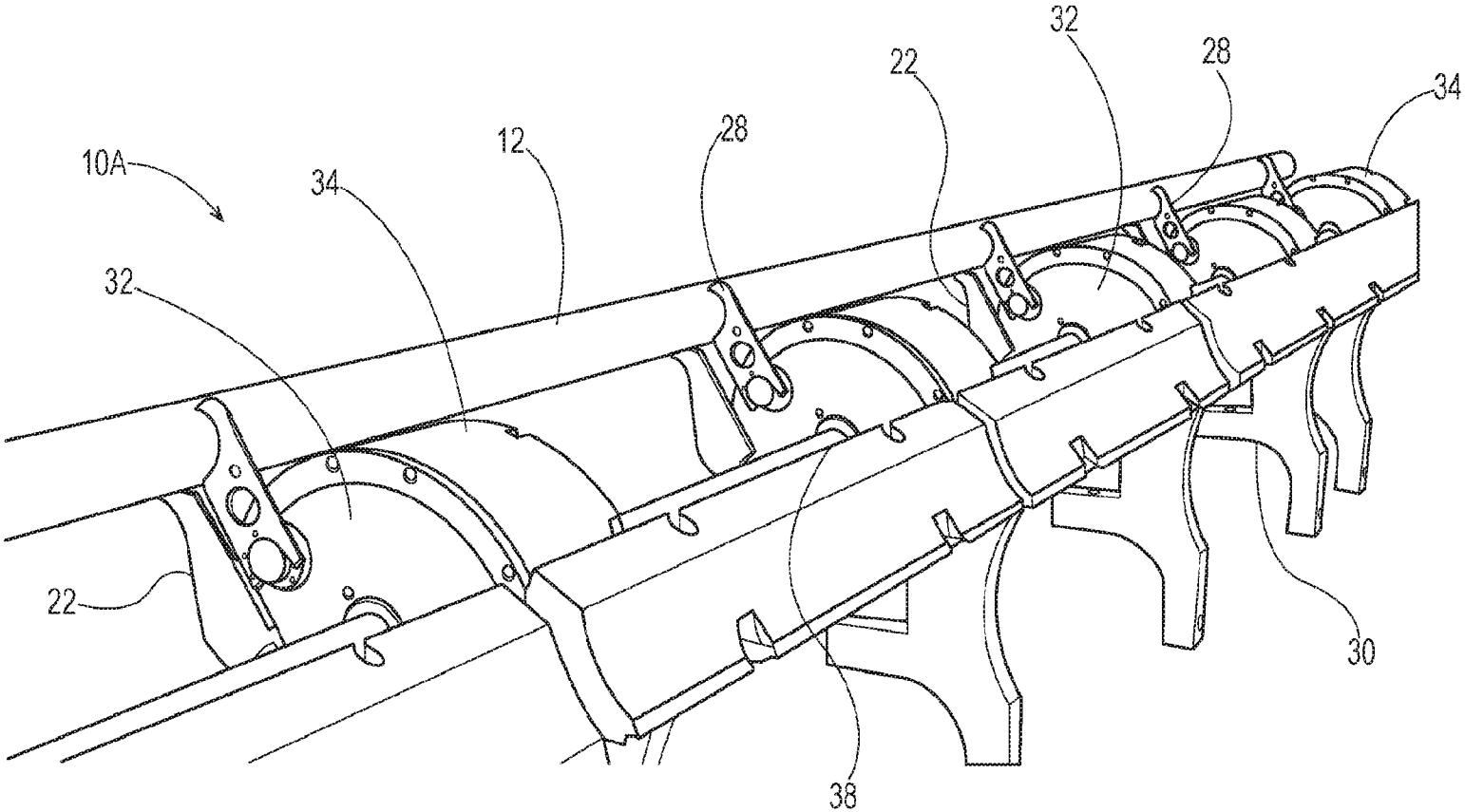
FIG. 13 is a perspective view of an exemplary cam-controlled core insertion device according to the present disclosure showing exemplary cam housings and associated fixed fingers and movable fingers showing alignment of the movable fingers about the core disposed therebetween.

This better alignment of each fixed finger 22/movable finger 28 pair across the width of the cam-controlled core inserter 10A relative to core 12 is shown in FIG. 13. Here, each fixed finger 22 and movable finger 28 pair is shown in contacting engagement with core 12 compared to the random engagement of each fixed finger 14/pivot finger 16 pair of core inserter 10 shown in FIG. 2.

Figure 14:
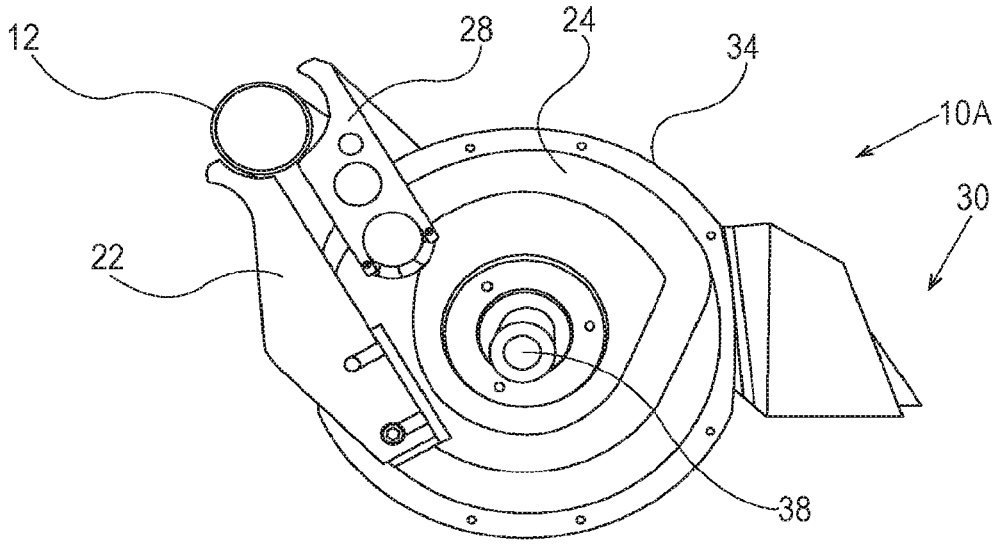
FIG. 14 is an exemplary elevational view of the cam-controlled core insertion device showing alignment of the movable fingers about the core at a first orbital position.
Figure 15:
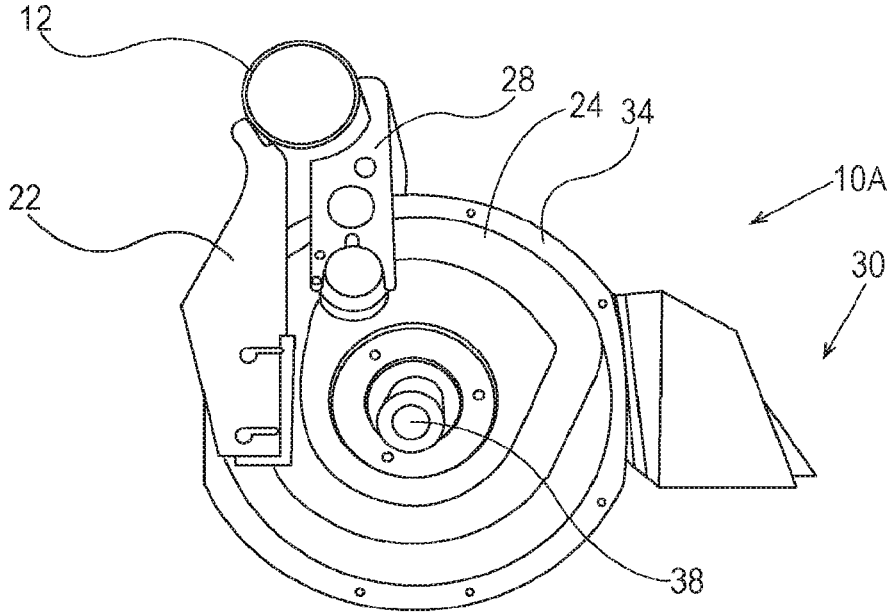
FIG. 15 is an exemplary elevational view of the cam-controlled core insertion device showing alignment of the fingers about the core in a mid-cycle orbital position.

As shown in representative FIGS. 13-15, it can be seen that all movable fingers 28 (e.g., a first finger, a second finger, a third finger, etc.) each associated with a respective cam housing 34 (e.g., a first cam housing, a second cam housing, a third cam housing, etc.) comprising cam-controlled core inserter 10A are similarly engaged with a respective core 12 when the core 12 contacts fixed finger 22. Each movable finger 28, cooperatively engaged with a respective cam follower 26 (e.g., a first cam follower, a second cam follower, a third cam follower, etc.), each disposed within or about a respective cam 24 (e.g., a first cam, a second cam, a third cam, etc.) disposed within a respective cam housing 34 can orbit in synchronicity about the longitudinal axis 38 of cam-controlled core inserter 10A with the other adjacent movable fingers 28, attached to a respective cam follower 26, disposed within respective cam 24 disposed within respective cam housings 34 to form cam-controlled core inserter 10A.

As shown more clearly in FIGS. 14-15, each fixed finger 22 and movable finger 28 combination of each cam-controlled core inserter 10A of the surface winder 100 of the present disclosure continues to maintain contact with the respective core 12 disposed therebetween.

Figure 16A:
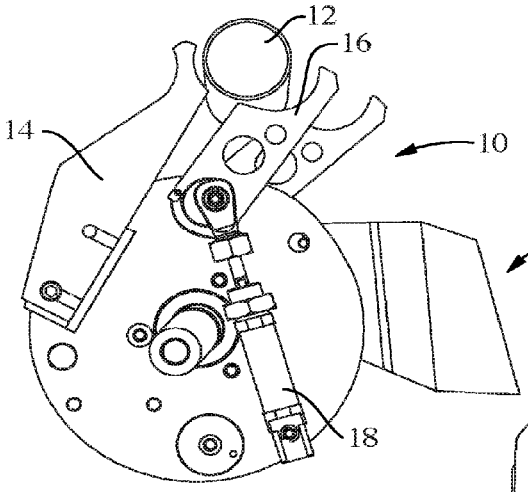
Fig. 16A (PRIOR ART)
FIG. 16A is an exemplary elevational view of the prior art core insertion device of FIG. 3 showing mis-alignment of the pivot fingers about the core in a mid-cycle position.

For purposes of comparison, FIGS. 16A,B-18A,B show the respective differences in core 12 control relative to winding cradle 30 of surface winder 100 for core inserter 10 of the prior art and cam-controlled core inserter 10A of the present disclosure.

As shown in FIG. 16A, at a position intermediate the contacting engagement of fixed finger 14 and pivot finger 16 of core inserter 10 relative to core 12, fixed finger 14 and pivot finger 16 must disengage contacting engagement with core 12 to allow all pivot fingers of core inserter 10 ample time to clear away from winding cradle 30. Ostensibly, this extra time required is due in large part to the uncertainty associated with the use of pneumatically activated cylinders 18 and any control systems to provide adequate time to retract all pivot fingers 16 away from core 12. At this point in time, core 12 is now unsupported and can be seen to assume any degree of misalignment with winding cradle 30. Further, the clear misalignment of all pivot fingers 16 can be seen.

Figure 16B:
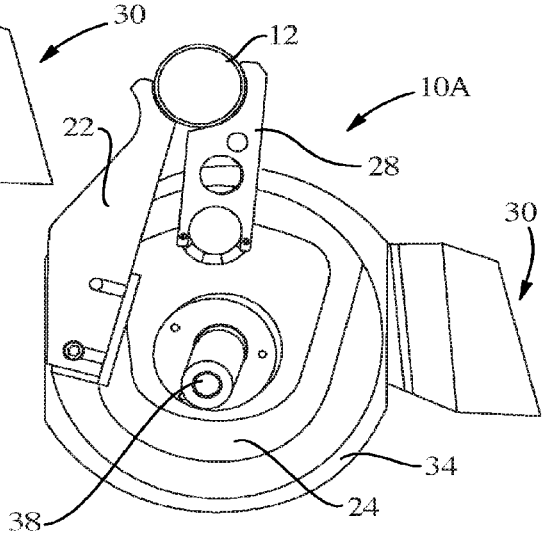
FIG. 16B is a comparative exemplary elevational view of the cam-controlled core insertion device of FIG. 13 showing alignment of the movable fingers about the core in a mid-cycle position comparable to that of FIG. 16A.

Comparatively, as shown in FIG. 16B, fixed finger 22 and movable finger 28 of exemplary cam-controlled core inserter 10A of the present disclosure are still in contacting engagement with core 12. Clearly, the position of core 12 is still highly controlled relative to winding cradle 30. As can be seen, all moveable fingers 28 are still aligned.

Figure 17A:
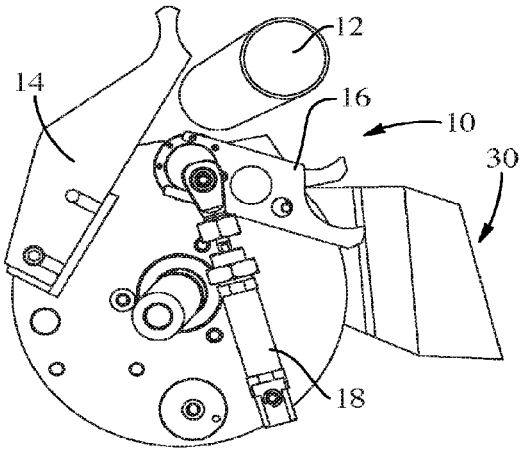
Fig. 17A (PRIOR ART)
FIG. 17A is an exemplary elevational view of the prior art core insertion device of FIG. 3 showing mis-alignment of the pivot fingers and disengagement from the core in a further mid-cycle position.

As shown in FIG. 17A, as the fixed fingers 14 of core inserter 10 approach winding cradle 30, all pivot fingers 16 are completely disassociated from contacting engagement with core 12. In fact, it appears that core 12 is positioned in 'free space' and approaching winding cradle 30 airborne. Clearly, it should be understood by one of skill in the art that such an airborne approach of core 12 toward winding cradle 30 can lead to misalignment and the uncertain disposition of the core 12 within winding cradle 12. Also, it becomes even less clear how the web material may eventually become disposed upon core 12.

Figure 17B:
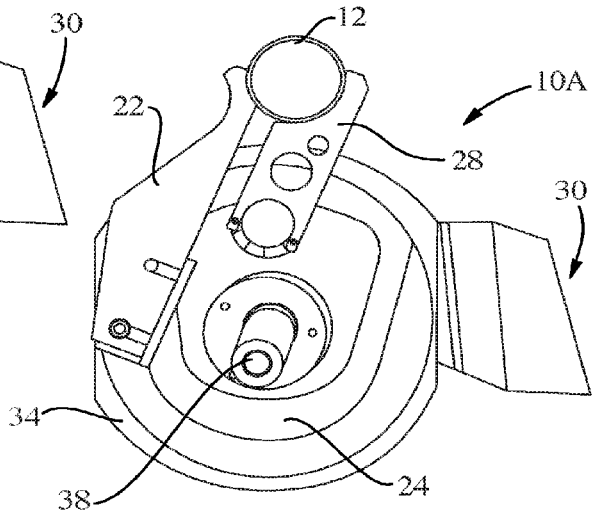
FIG. 17B is a comparative exemplary elevational view of the cam-controlled core insertion device of FIG. 13 showing alignment and continuing contacting engagement of the movable fingers about the core in a mid-cycle position comparable to that of FIG. 17A.

Conversely, as shown in FIG. 17B, core 12 remains in contacting engagement with fixed finger 22 and movable finger 28 of cam-controlled core inserter 10A as the core 12 approaches winding cradle 30. Clearly, the cam-controlled core inserter 10A of the present disclosure is providing more certainty relative to the insertion of a core 12 into a surface winder 100 process.

Figure 18A:
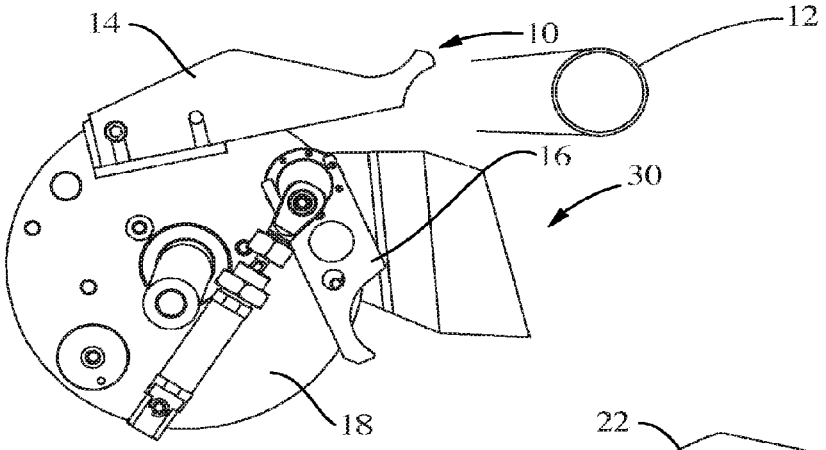
Fig. 18A (PRIOR ART)
FIG. 18A is an exemplary elevational view of the prior art core insertion device of FIG. 3 showing complete disengagement of the pivot fingers from the core near the intended discharge point.

Turning to FIG. 18A, it can be seen that core 12 is completely missing and likely mis-inserted into winding cradle 30 of surface winder 100 as fixed finger 14 approached winding cradle 30. Pneumatically actuated cylinders 18 have completely retracted allowing re-alignment of all pivot fingers 16.

Figure 18B:
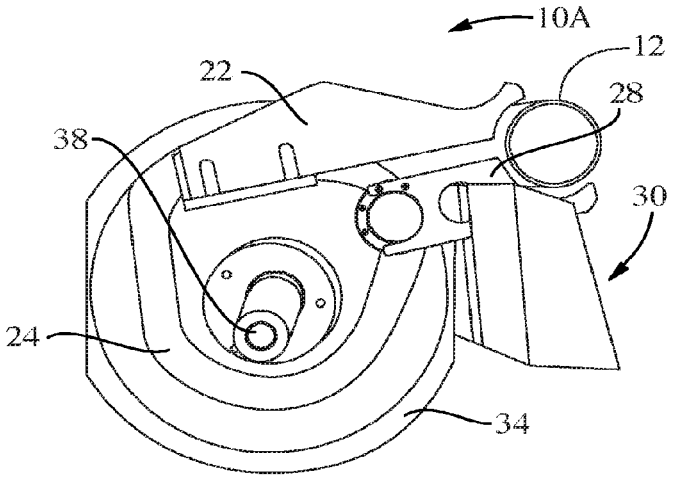
FIG. 18B is a comparative exemplary elevational view of the cam-controlled core insertion device of FIG. 13 showing alignment and continuing contacting engagement of the movable fingers about the core near the intended discharge point comparable to that of FIG. 18A.

Contrastingly, FIG. 18B shows that as fixed finger 22 of cam-controlled core inserter 10A of the present disclosure approaches winding cradle 30 of surface winder 100, fixed finger 22 and movable finger 28 of cam-controlled core inserter 10A still remain in contacting engagement with core 12. This provides a deeper insertion of core 12 into winding cradle 30. One of skill in the art will appreciate that a deeper insertion of core 12 into winding cradle 30 provides a more reliable process as the winding system has not lost control of the core 12. At this point it is envisioned that cam 24 is designed to allow cam follower 26 and movable finger 28 attached thereto to relocate away from core 12 and fixed finger 22 to release the core 12 directly into contacting engagement with winding cradle 30 of surface winder 100. At this point, it is envisioned that fixed finger 22 and movable finger 28 through respective cam followers 26 will re-cycle back to an operating position of zero machine degrees to provide for contacting engagement with a succeeding core 12 to be inserted into winding cradle 30 of surface winder 100.

Returning to FIG. 5, it was also found that face of the cam-controlled core inserter 10A providing the cam 24 disposed therein can be covered with a shroud 32. Such a shroud 32 can enable replacement and re-build of each unit comprising cam-controlled core inserter 10A in a faster time frame. Additionally, cam housing 34 and fixed finger plate 46 can be manufactured to comprise two halves that can be easily separated and conjoined in situ. This can facilitate repair and/or re-building of each cam housing 34 and/or fixed finger plate 46, as well as the other associated components of cam-controlled core inserter 10A without the need to completely disassemble and remove each and every component of cam-controlled core inserter 10A sequentially and/or serially from shaft 40. In other words, each component of cam-controlled core inserter 10A can be individually removed and replaced/re-built. This is a stark contrast to the current core inserters 10 that require complete dismantling of every component from the respective shaft 40 in order to effectuate a repair or re-build.

Further, it would be advantageous and understood by one of skill in the art to manufacture cam housing 34 and cam 24 in the form of a uni-body construction. Such uni-body constructions typically enable building parts one layer at a time through the use of typical techniques such as SLA/stereo lithography, SLM/Selective Laser Melting, RFP/Rapid freeze prototyping, SLS/Selective Laser sintering, SLA/Stereo lithography, EFAB/Electrochemical fabrication, DMDS/Direct Metal Laser Sintering, LENS®/Laser Engineered Net Shaping, DPS/Direct Photo Shaping, DLP/Digital light processing, EBM/Electron beam machining, FDM/Fused deposition manufacturing, MJM/Multiphase jet modeling, LOM/Laminated Object manufacturing, DMD/Direct metal deposition, SGC/Solid ground curing, JFP/Jetted photo polymer, EBF/Electron Beam Fabrication, LMJP/liquid metal jet printing, MSDM/Mold shape deposition manufacturing, SALD/Selective area laser deposition, SDM/Shape deposition manufacturing, combinations thereof, and the like. However, as would be recognized by one familiar in the art, such a uni-body cam housing 34 and cam 24 system can be constructed using these technologies by combining them with other techniques known to those of skill in the art such as casting.

In still yet another non-limiting example, cam housing 34 and cam 24 could be fabricated separately and combined into a cam housing 34/cam 24 assembly. This can facilitate assembly and repair work to the parts of the cam housing 34/cam 24 such as coating, machining, heating and the like, etc. before they are assembled together to make a complete cam-controlled core inserter 10A. In such techniques, two or more of the components of a cam-controlled core inserter 10A commensurate in scope with the instant disclosure can be combined into a single integrated part.

Further the use of less components of cam-controlled core inserter 10A relative to core inserter 10 can be considerably easier by removing any requirement to remove the cam-controlled core inserter 10A, and any components thereof from the re-winder 100. Furthermore, disposing shroud 32 around to the face of each cam housing 34 can provide a sealing function that can actively protect any critical moving parts such as cam follower 26 and any components thereof from contamination.

In another embodiment, the cam follower 26 is in an "active" configuration for orbital rotation within or about cam 24. It is envisioned that inertia can be provided to a particular cam follower 26 to allow the cam follower 26 to orbit about the longitudinal axis 38 within cam 24. By way of non-limiting example, a plurality of electromagnets can be provided within or upon cam follower 26 that can generate an electromotive force (EMF) sufficient to propel a cam follower 26 to orbit about the longitudinal axis 38 within cam 24. Naturally, one of skill in the art would recognize that other arrangements can be used to provide a particular cam follower 26 with a motion such as a belt drive, gear drive, and the like. If used, it is believed that the electromagnets can be provided as a plurality of individual electromagnets or as a single linear electromagnet.

In any regard it would be possible to provide control programming to cause a particular series of individual electromagnets or a single linear electromagnet to provide the necessary and/or desired motion to a cam follower 26 necessary to maintain concerted and cooperative engagement with a cam 24 cooperatively associated thereto while orbiting about the longitudinal axis 38 within or upon cam 24. Such a motion profile can be used to provide each cam follower 26 with a characteristic motion about the longitudinal axis 38 that may be required at a particular position.

As would be understood by one of skill in the art, cam-controlled core inserter 10A of the present disclosure can provide several benefits over previous core inserters 10. These are, without limitation: 1. Increased restriction in the movement of movable finger 28 in both an 'open' (i.e., non-contacting engagement with core 12) and 'closed' (i.e., contacting engagement with core 12) directions; 2. Increased production speed due to better and longer control of the core 12 prior to insertion into winding cradle; 3. Better machine reliability due to a reduced number of parts within the cam-controlled core inserter 10A of the present disclosure; 4. Better reliability due to the capability of both the fixed fingers 22 and movable fingers 28 to rotate past each other when there is contact due to equipment failure or accident; 5. Facilitating a rapid re-setting of a mechanical failure/accident condition in an instance where magnets are used; 6. More control of securing/release of the core 12 so the core 12 can be held by cam-controlled core inserter 10A longer and inserted into the winding cradle 30 in a more stable manner; 7. Providing a more precise positioning and application of an adhesive (e.g., a 'glue stripe') to the core 12 prior to presentation and contact of the web material to the core 12; 8. An increased resistance to hygiene and contamination issues; and 9. Rapid replacement and serviceability.

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cam-controlled core insertion device for a surface winder, said cam-controlled core insertion device comprising:

a cam housing having a longitudinal axis disposed therethrough;

a cam disposed within a first surface of said cam housing, said cam being disposed within said cam housing about said longitudinal axis;

a fixed finger plate juxtaposed proximate to said cam housing and said cam and having a fixed finger fixably attached thereto, said fixed finger plate being fixably attached to a shaft disposed through said cam housing, said shaft being disposed coaxially about said longitudinal axis and being rotatable thereabout, said fixed finger having a fixed orientation relative to said longitudinal axis as said shaft rotates about said longitudinal axis, said fixed finger having an end distal from said fixable attachment to said fixed finger plate;

a first cam follower cooperatively associated with said cam, said first cam follower having a finger shaft attached thereto, said finger shaft being disposed through said fixed finger plate and having a movable finger attached thereto, wherein said first cam follower orbits about said longitudinal axis while juxtaposed proximate to and in contacting engagement with said cam, said movable finger having an adjustable orientation relative to said longitudinal axis as said first cam follower orbits about said longitudinal axis, said movable finger having an end distal from said first cam follower;

wherein said distal end of said movable finger and said distal end of said fixed finger are capable of forming a space therebetween for contacting engagement and containment of a core suitable for the convolute disposal of a web material thereabout;

wherein said cam causes said movable finger to rotate toward said fixed finger when said first cam follower is disposed at a first orbital position relative to said longitudinal axis to engage said core between said distal end of said movable finger and said distal end of said fixed finger; and, wherein said cam causes said movable finger to rotate away from said fixed finger to disengage from said core when said first cam follower is disposed at a second orbital position relative to said longitudinal axis.

2. The cam-controlled core insertion device of claim 1 wherein said first cam follower orbits about said longitudinal axis while disposed within said cam.

3. The cam-controlled core insertion device of claim 2 wherein said cam further comprises a first cam track portion and a second cam track portion.

4. The cam-controlled core insertion device of claim 3 wherein said cam follower further comprises a first cam follower bearing and a second cam follower bearing, said first cam follower bearing provided in contacting and roller-like engagement with said first cam track portion and said second cam follower bearing provided in contacting and roller-like engagement with said second cam track portion.

5. The cam-controlled core insertion device of claim 1 wherein said first cam follower orbits about said longitudinal axis while disposed about said cam.

6. The cam-controlled core insertion device of claim 1 wherein said fixed finger plate further comprises a latch, said latch being disposed in an orientation upon said fixed finger plate that provides cooperative engagement with said fixed finger.

7. The cam-controlled insertion device of claim 6 wherein said latch secures said fixed finger in a fixed orientation relative to said shaft and said longitudinal axis as said shaft and said fixed finger plate rotate about said longitudinal axis.

8. The cam-controlled insertion device of claim 6 wherein said latch enables pivotable movement of said fixed finger in a direction generally away from said moveable finger.

9. The cam-controlled insertion device of claim 6 wherein said latch is selected from the group consisting of magnetic latches, shear pins, slip-clutches, and combinations thereof.

10. The cam-controlled core insertion device of claim 1 further comprising:

a second cam housing disposed about said longitudinal axis and adjacent said cam housing, said cam housing and said second cam housing being collectively elongate;

a second cam disposed within a first surface of said second cam housing, said second cam being disposed within said second cam housing about said longitudinal axis;

a second fixed finger plate juxtaposed proximate to said second cam housing and said second cam and having a second fixed finger fixably attached thereto, said second fixed finger plate being fixably attached to said shaft disposed through both said first and second cam housings, said second fixed finger having a fixed orientation relative to said longitudinal axis as said shaft rotates about said longitudinal axis, said second fixed finger having an end distal from said fixable attachment to said second fixed finger plate;

a second cam follower cooperatively associated with said second cam, said second cam follower having a second finger shaft attached thereto, said second finger shaft being disposed through said second fixed finger plate and having a second movable finger attached thereto, wherein said second cam follower orbits about said longitudinal axis while juxtaposed proximate to and in contacting engagement with said second cam, said second movable finger having an adjustable orientation relative to said longitudinal axis as said second cam follower orbits about said longitudinal axis, said second movable finger having an end distal from said second cam follower;

wherein said distal end of said second movable finger and said distal end of said second fixed finger are capable of forming a space therebetween for contacting engagement and containment of said core;

wherein said second cam causes said second movable finger to rotate toward said second fixed finger when said second cam follower is disposed at said first orbital position to engage said core between said distal end of said second movable finger and said distal end of said second fixed finger; and, wherein said second cam causes said second movable finger to rotate away from said second fixed finger to disengage from said core when said second cam follower is disposed at said second orbital position.

11. The cam-controlled core insertion device of claim 10 wherein said cam housing, said second cam housing, said fixed finger plate, and said second fixed finger plate each comprise two mutually and cooperatively engageable halves.

12. The cam-controlled core insertion device of claim 11 wherein said cam housing, said second cam housing, said fixed finger plate, and said second fixed finger plate are each removable from said surface winder.

13. The cam-controlled core insertion device of claim 10 wherein said second cam follower orbits about said longitudinal axis while disposed within said second cam.

14. The cam-controlled core insertion device of claim 13 wherein said first cam follower and said second cam follower synchronously orbit about said longitudinal axis.

15. The cam-controlled core insertion device of claim 10 wherein said cam and said second cam are similar.

16. The cam-controlled core insertion device of claim 10 wherein said cam and said second cam are identical.

17. The cam-controlled core insertion device of claim 10 wherein said second cam follower orbits about said longitudinal axis while disposed about said second cam.

18. The cam-controlled core insertion device of claim 10 wherein said second cam housing and said second fixed finger plate each comprise two mutually and cooperatively engageable halves.

19. The cam-controlled core insertion device of claim 10 wherein said second fixed finger plate further comprises a second latch, said second latch being disposed in an orientation upon said second fixed finger plate that provides cooperative engagement with said second fixed finger, said second latch securing said second fixed finger in a fixed orientation relative to said shaft and said longitudinal axis as said shaft and said second fixed finger plate rotate about said longitudinal axis.

20. The cam-controlled insertion device of claim 19 wherein said second latch enables pivotable movement of said second fixed finger in a direction generally away from said second moveable finger.

* * * * *